United States Patent [19]

Fitch

[11] 4,132,504

[45] Jan. 2, 1979

[54] LIQUID RING PUMP

[75] Inventor: James B. Fitch, Marshfield, Mass.

[73] Assignee: General Signal Corporation, Rochester, N.Y.

[21] Appl. No.: 674,707

[22] Filed: Apr. 7, 1976

[51] Int. Cl.[2] ..... F04C 19/00

[52] U.S. Cl. ..... 417/68; 418/238

[58] Field of Search ..... 417/68, 69, 62, 238, 417/250; 415/119; 416/178, 500; 29/156.4 R, 156.8 B

[56] References Cited

U.S. PATENT DOCUMENTS

| | | | |
|---|---|---|---|
| 1,525,332 | 2/1925 | Sommer | 417/68 |
| 1,797,980 | 3/1931 | Jennings | 417/68 |
| 1,847,586 | 3/1932 | Adams | 417/68 |
| 1,973,019 | 9/1934 | Shore | 417/68 |
| 2,381,700 | 8/1945 | Smith | 417/68 |
| 2,416,538 | 2/1947 | Nelson | 417/68 |
| 2,419,411 | 4/1947 | Mayne | 416/178 |
| 3,108,738 | 10/1963 | Luhmann | 417/68 |
| 3,228,587 | 1/1966 | Segebrecht | 417/68 X |
| 3,285,502 | 11/1966 | Wooden | 415/119 |
| 3,712,764 | 1/1973 | Shearwood | 417/68 |
| 3,823,063 | 7/1974 | Callahan et al. | 415/195 X |

FOREIGN PATENT DOCUMENTS

| | | | |
|---|---|---|---|
| 1116339 | 11/1961 | Fed. Rep. of Germany | 417/68 |

*Primary Examiner*—Carlton R. Croyle
*Assistant Examiner*—Edward Look
*Attorney, Agent, or Firm*—Pollock, Vande Sande & Priddy

[57] ABSTRACT

An improved liquid ring pump includes an impeller having a larger axial length to diameter ratio than found in the prior art, with suction ports at both ends of the impeller. The number of impeller blades is chosen to be a prime number, preferably thirteen, to reduce pump noise and vibration. The pump housing includes novel manifolding for parallel or compound pump arrangements having two impellers, with suction ports at both ends of at least one impeller. A unique joint configuration between housing sections is also disclosed.

12 Claims, 8 Drawing Figures

LIQUID RING PUMP

CROSS-REFERENCE TO RELATED APPLICATIONS

The invention disclosed in this application is related to those shown in my copending applications Ser. Nos. 674,347 for IMPROVED LIQUID RING PUMP, and 674,335, now abandoned, for METHOD AND APPARATUS FOR ASSEMBLING LIQUID RING PUMP HOUSING, filed concurrently herewith.

BACKGROUND OF THE INVENTION

Liquid ring pumps have been widely used in industry in applications where smooth, non-pulsating gas or vapor removal is desired. While known designs such as those shown in U.S. Pat. Nos. 2,940,657 and 3,221,659 issued to H. E. Adams; 3,209,987, issued to I. C. Jennings; and 3,846,046, issued to Kenneth W. Roe and others, have achieved a significant measure of success, recent increases in manufacturing and operating expenses for such pumps and the increasing need for special materials and coatings in pump components have created renewed demand for pumps more economical to build and operate.

OBJECTS OF THE INVENTION

An object of the invention is to provide a liquid ring pump having a casing or housing of simpler geometry than known heretofore, which permits the use of simple, direct-draw castings with simplified joint geometry compatible with the machinability of anti-corrosive coatings such as glass.

Another object of the invention is to provide a liquid ring pump having a unique impeller design chosen to minimize operating vibration and noise of the device and reduce leakage past the impeller blades.

A further object of the invention is to provide a liquid ring pump having a plurality of casing sections joined by simple butt joints with aligning dowels.

Still another object of the invention is to provide a liquid ring pump having suction and discharge ports located at both ends of the impeller, which permit the use of longer axis, smaller diameter impellers to reduce blade friction by optimizing blade tip velocity, thereby increasing pump efficiency.

Yet another object of the invention is to provide a liquid ring pump having suction and exhaust manifolding which, with simple modifications, permits operation as a two-stage compound pump or a single-stage parallel pump, with numerous common components between the two configurations.

A still further object of the invention is to provide a liquid ring pump of the compound or parallel type in which the manifolds between stages are formed integrally with the housing sections of the pump.

The above objects of the invention are given only by way of example. Thus, those skilled in the art may perceive other desirable objects and advantages inherently achieved by the invention. Nonetheless, the scope of the invention is to be limited only by the appended claims.

SUMMARY OF THE INVENTION

The above objects of the invention and other advantages are achieved by the disclosed pumping apparatus which is especially suited for pumping gases, vapors, and mixtures thereof. A casing is provided having a single pumping chamber therein with a rotary impeller mounted eccentrically for rotation within the chamber. The impeller includes a plurality of radial displacement chambers and has a diameter and an axial length, the ratio of the axial length to the diameter preferably being in the range from approximately 1.2 to approximately 1.5. Suction ports for admitting fluid to the impeller are located at each end of the impeller. In some embodiments of the invention, one impeller is used as the first stage of a compound pump with discharge flow from either end of the first impeller being directed to suction ports at either end of a second, similar impeller.

The invention also comprises a pumping apparatus having an improved rotary impeller which includes a prime number of radial displacement chambers for pumping fluids. An improved housing or casing structure is provided which comprises a plurality of essentially cylindrical sections with flat, radially extending end mating surfaces therebetween. A plurality of protrusions and depressions such as dowels and holes are provided on the mating surfaces to orient the housing sections radially and circumferentially.

DETAILED DESCRIPTION OF THE PREFERRED EMBODIMENTS

Figure 1:
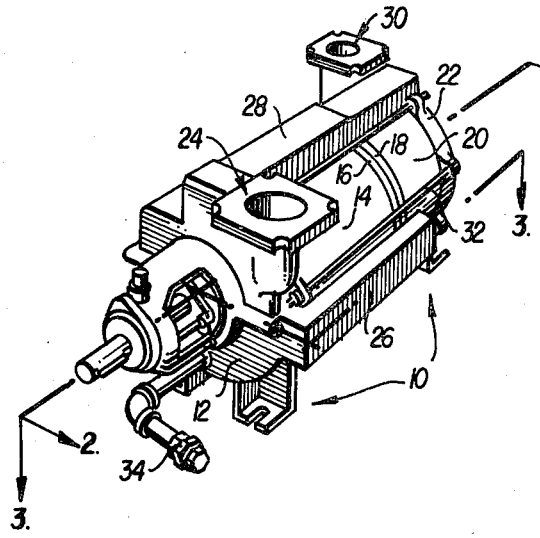
FIG. 1 shows a perspective view of the exterior of an assembled compound pump embodying the present invention.

There follows a detailed description of the preferred embodiments of the invention, reference being had to the drawings in which like reference numerals identify like elements of structure in each of the several figures.

FIG. 1 shows a perspective view of a compound pump embodying the features of the invention. A pump housing or casing 10 comprises a suction end casing 12, a first stage body portion 14, first stage center plate 16, second stage center plate 18, second stage body portion 20 and discharge end casing 22. A suction inlet 24 directs fluids such as gas or vapor into suction end casing 12 and suction manifold 26. Suction manifold 26 connects in parallel the suction ports located at either end of the impeller of the first stage, as shown more clearly in FIGS. 2 and 3. A discharge manifold 28, formed integrally with the casing sections previously mentioned, directs discharge gases or vapors from the discharge ports of the first stage to suction ports located at either end of the impeller of the second stage. Gases or vapors leaving the discharge port of the second stage are directed into discharge end casing 22 and leave the apparatus via discharge outlet 30. A plurality of tie bolts and nuts 32 are provided to clamp the various casing sections to one another. Finally, an inlet chamber 34 is provided for admitting seal liquid to the interior of casing 10.

Figure 2:
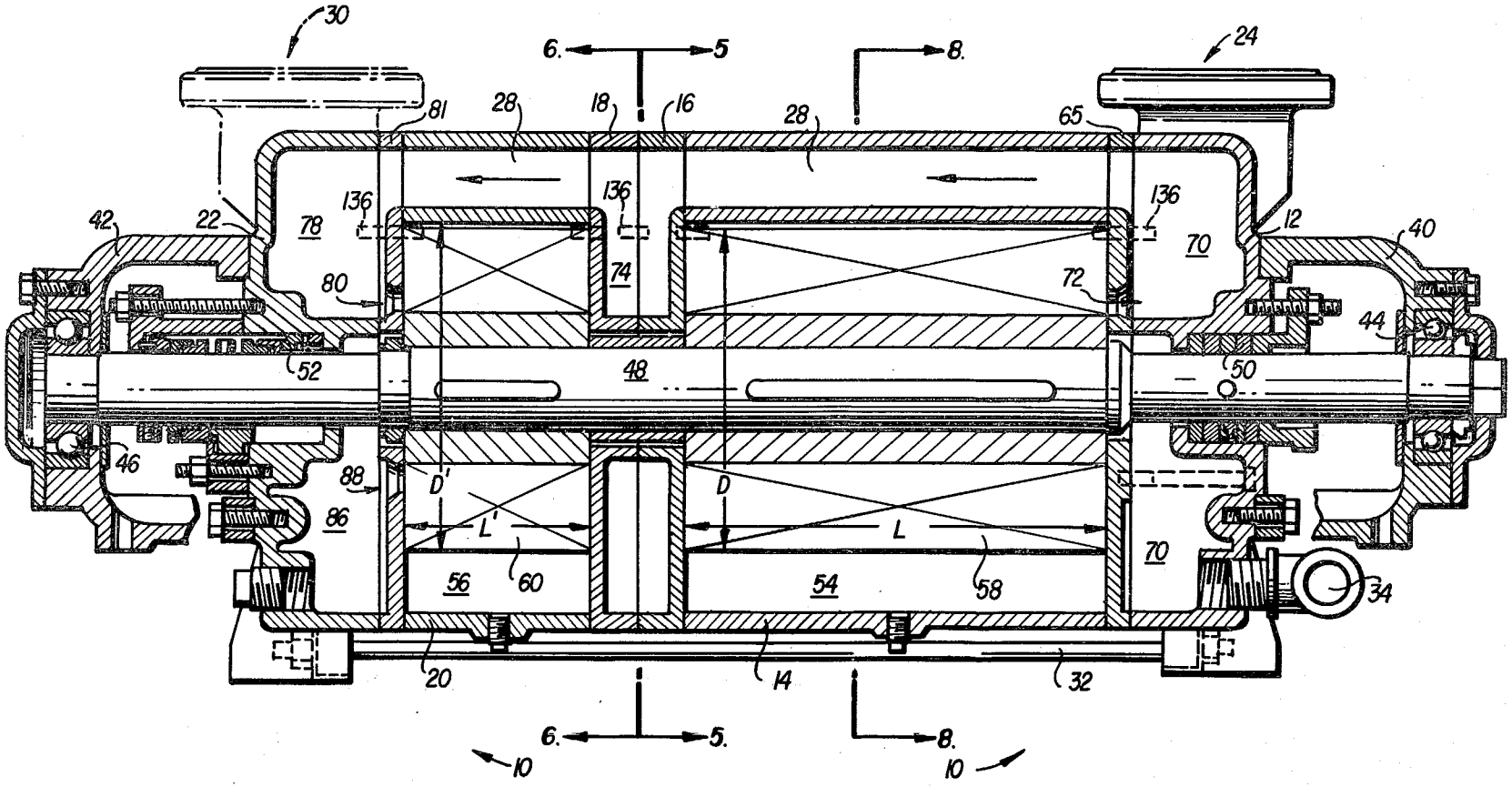
FIG. 2 shows an elevation section taken on line 2—2 of FIG. 1, indicating the internal components of the invention.
Figure 3:
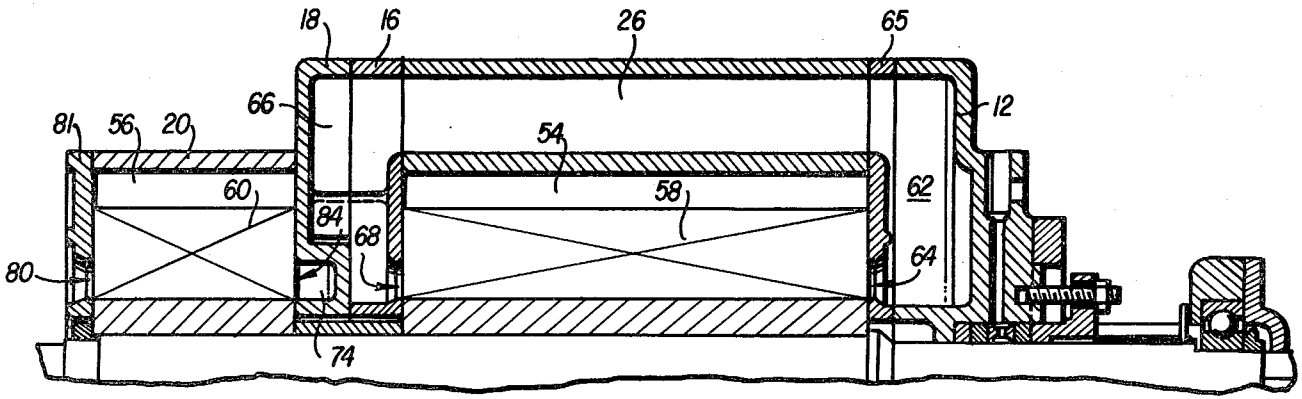
FIG. 3 shows a partial, horizontal section taken on line 3—3 of FIG. 1.

The views of FIGS. 2 and 3, taken along lines 2—2 and 3—3 of FIG. 1, illustrates the primary interior components of the invention. A suction end bearing housing 40 and a discharge end bearing housing 42 support shaft bearings 44 and 46. A shaft 48, mounted for rotation within bearings 44 and 46, passes through seals 50 and 52 located in suction end casing 12 and discharge end casing 22. In the familiar manner for liquid ring pumps, shaft 48 is mounted eccentrically within both the first stage pumping chamber 54 defined by a first stage body portion 14, and the second stage pumping chamber 56 defined by second stage body portion 20. Both chambers 54 and 56 are free of any radial walls or baffles extending toward the centers of body portions 14 and 20; thus, ring liquid and gases or vapors being pumped can flow from one end of each chamber to the other without encountering any obstructions other than shaft 48 and its impeller. A first stage impeller 58 having an axial length "L" and a diameter "D" is mounted on shaft 48 for rotation therewith within chamber 54. Also mounted on shaft 48 for rotation within chamber 56 is a second stage impeller 60 having an axial length "L'" and a diameter "D'".

Those familiar with liquid ring pump design will appreciate that the pumping capacity of the pump is influenced to a great extent by the axial length and the diameter of the impeller. Together with the pump speed and the thickness of the liquid ring itself, these dimensions control the displacement of the pump to a great extent. Where additional capacity is desired at a given operating speed, the prior art teaches that the impeller diameter may be increased, thereby increasing the volume of the radial displacement chambers between impeller blades. However, this also increases the tangential speed of the tips of the longer impeller blades, with an attendant increase in friction which must be overcome by applying more power to the shaft to maintain speed. Of course, the housing diameter also becomes larger. In prior art pumps, attempts have been made to increase pump capacity by axially lengthening the impeller without changing impeller diameter. These attempts have been unsuccessful, however, due to undesirable drops in pump efficiency where the length-to-diameter ratio of the impeller exceeded about 1.06.

Applicant has discovered that the impeller diameter actually can be reduced to minimize friction at a given speed and the axial length can be increased to maintain displacement with an unexpected improvement in overall pump performance, provided suction, and preferably discharge, ports are located at both ends of the impeller. Length to diameter ratios greater than 1.06 and preferably in the range of approximately 1.2 to 1.5 have been found to produce lower power consumption due to reduced tip speed, without losing volumetric efficiency. Of course, the use of ratios outside this range is within the scope of the invention where opposite end suction ports are used. The opposite end suction ports improve the breathing of the pump compared to single end ports so that substantially the entire volume between each pair of impeller blades is effective during pumping. In the prior art devices, an impeller with a length-to-diameter ratio of greater than 1.06 and with a suction port at only one end would be "starved" at the end opposite the single suction port, which reduces volumetric efficiency. While the invention is illustrated for use with a single lobe liquid ring pump, those skilled in the art will realize that the teachings thereof may also be applied to double or other multiple lobe pumps.

Continuing in FIGS. 2 and 3, the flow path for vapors or gases entering the pump is through suction inlet 24 to a first stage inlet plenum 62 and then through a suction port 64 which is located in first stage end plate 65. Inlet flow also proceeds in parallel through integral manifold 26 to parallel first stage inlet plenum 66 which is defined between the first stage center plate 16 and the second stage center plate 18. From plenum 66, flow passes through suction port 68 which is located in first stage center plate 16. Discharge flow from the first stage chamber 54 is into first stage discharge plenum 70 through discharge port 72 also located in first stage end plate 65. The first stage also discharges in parallel to a first stage discharge plenum 74 located between center plates 16 and 18, through a discharge port 76. The flows from plenums 66 and 70 mix in plenum 74 and discharge manifold 28. A portion of the discharge from the first stage flows on through manifold 28 through second stage inlet plenum 78 and through a suction port 80 located in second stage and plate 81. The remainder of the discharge from the first stage passes through plenum 74 which serves as a parallel second stage inlet plenum. A second suction port 84 passes through plate 18 at a location opposite suction port 80. Discharge from the second stage flows through a discharge port 88 located in end plate 81 into a discharge plenum 86, located in discharge end casing 22. Thereafter, the gases or vapors leave the apparatus via discharge outlet 30. The actual sizes and circumferential locations of the opposite end suction and discharge ports of the invention are conventionally determined for a particular pump application, depending on factors such as desired suction and discharge pressures, pump operating speed, the fluid to be pumped and related factors familiar to those in the art.

Figure 4:
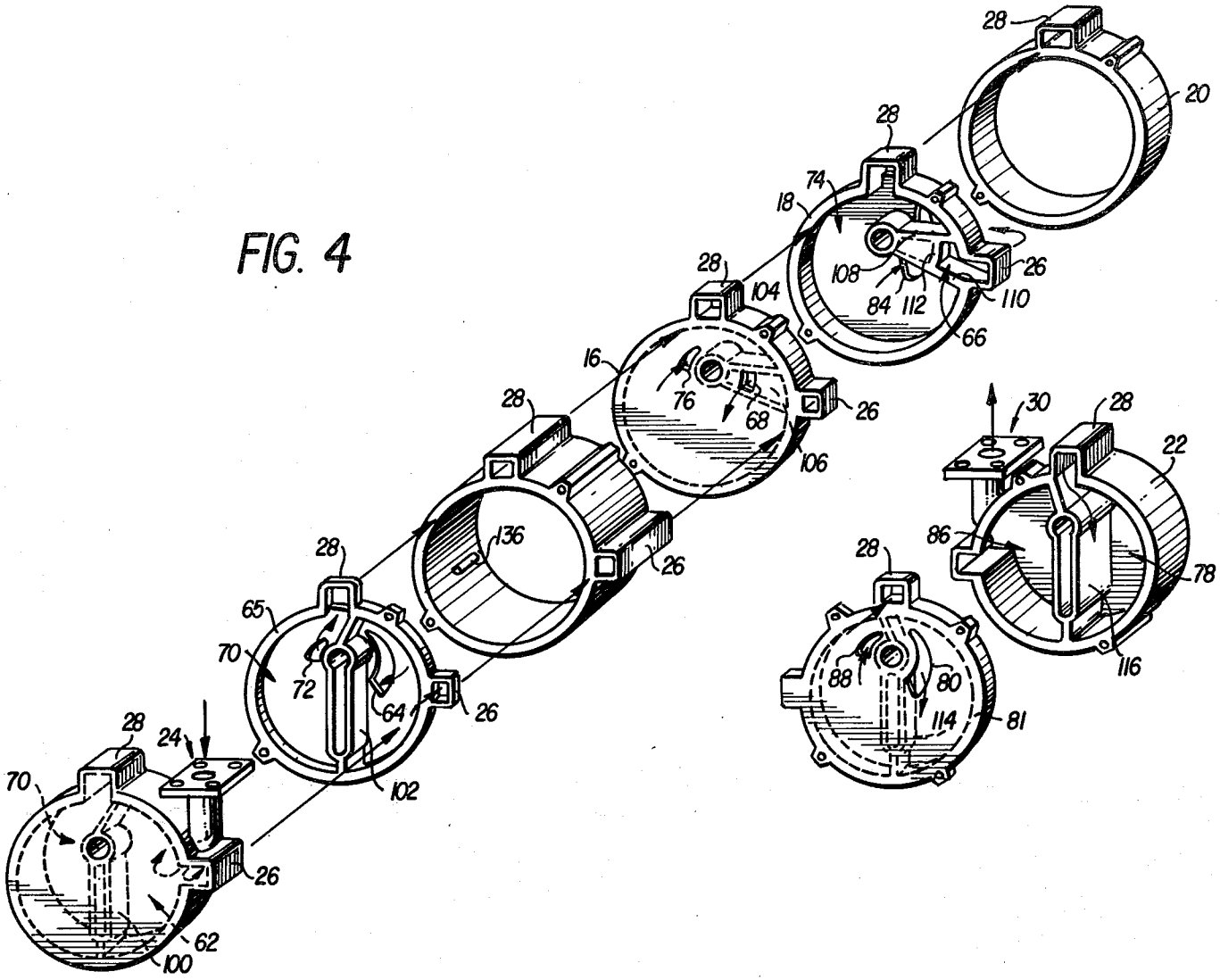
FIG. 4 shows an exploded view of the casing sections of a compound pump apparatus according to the invention.

Turning now to FIG. 4, an exploded view of housing or casing 10 is shown to indicate more specifically the unique flow directing manifolds according to the invention. Suction end casing 12 includes an interior wall 100 (shown in phantom) which separates plenums 62 and 70. Wall 100 also includes a through bore for shaft 48. First stage end plate 65 includes an interior wall 102 which is congruent with interior wall 100 to separate ports 64 and 72.

First stage center plate 16 includes radially extending interior walls 104 and 106 (shown in phantom) which separate ports 68 and 76. Second stage center plate 18 includes radially extending interior walls 108 and 110 which are oriented to be congruent with walls 104 and 106. A circumferential wall segment 112 extends between radial interior walls 108 and 110 to separate plenum 66 from plenum 74. The details of center plates 16 and 18 are discussed hereinafter in detail with regard to FIGS. 5 and 6.

Second stage end plate 81 and discharge end casing 22 include congruent interior walls 114 (in phantom) and 116 similar in function and location to interior walls 100 and 102. Walls 114 and 116 separate plenums 78 and 86 and suction and discharge ports 80 and 88.

Suction manifold 26 is defined by integral, radially extending portions of suction end casing 12, first stage end plate 65, first stage body portion 14, first stage center plate 16 and second stage center plate 18. In the assembled pump, these extending portions are joined together in flow through relationship, as shown in FIG. 1.

Similarly, discharge manifold 28 is defined by integral, radially extending portions of suction end casing 12, first stage end plate 65, first stage body portion 14, first stage center plate 16, second stage center plate 18, second stage body portion 20, second stage end plate 81 and discharge end casing 22. In the assembled pump, these portions are also joined in flow through relationship.

Figure 5:
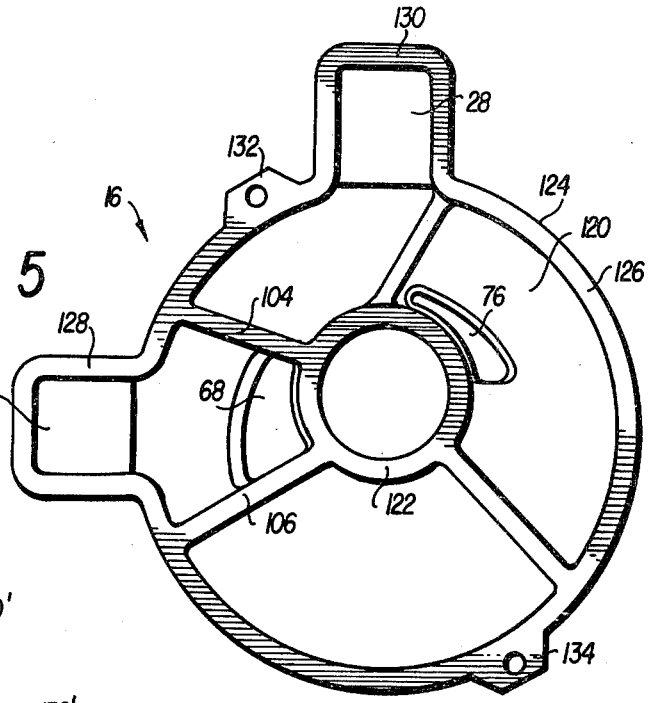
FIG. 5 shows a view taken along line 5—5 of FIG. 2, showing the details of the first stage center plate or manifold according to the invention.

Turning now to FIG. 5, first stage center plate 16 comprises an essentially flat disc 120 having a central boss 122 surrounding a bore for shaft 48. An axially extending peripheral lip 124 surrounds disc 120 and includes flat mating surface 126 which extends across the thickness of lip 124. Radially extending flanges 128 and 130 are provided which include through passages oriented to form portions of manifolds 26 and 28 in the assembled pump as also shown in FIG. 4. Ports 68 and 76 are isolated by radially extending walls 104 and 106 which extend from peripheral lip 124 to boss 122 on either side of suction port 68.

Figure 6:
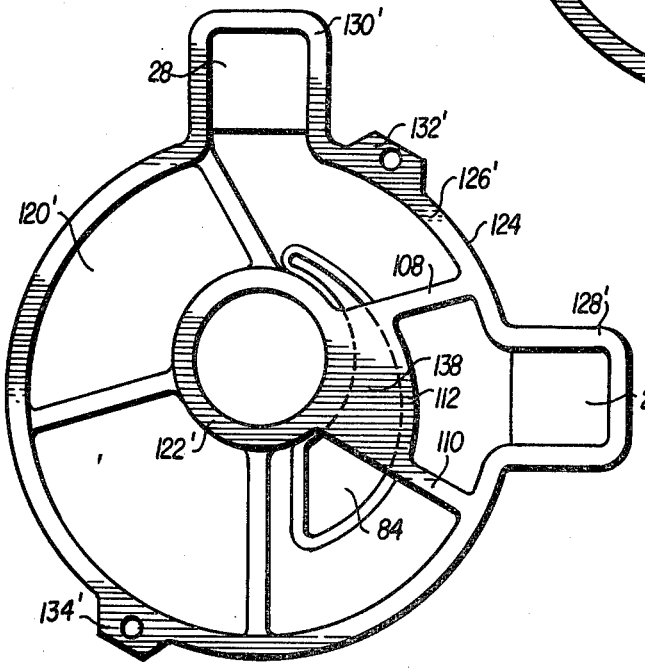
FIG. 6 shows a view taken along line 6—6 of FIG. 2 showing the details of the second stage center plate manifold according to the invention.

FIG. 6 shows a view taken along line 6—6 of FIG. 2 indicating the geometry of second stage center plate 18. Center plate 18 comprises an essentially flat disc 120' having a central boss 122' with a central bore for shaft 48. A peripheral lip 124' is provided which has a flat mating surface 126' extending across the thickness of lip 124. Radially extending walls 108 and 110 and the mating surface of lip 124' are congruent with their counterparts on first stage center plate 16. A seal plate 138 extends from wall 112 to boss 122 to isolate plenum 66 from plenum 74. That is, the suction port 68 is isolated from the suction port 84.

Figure 7:
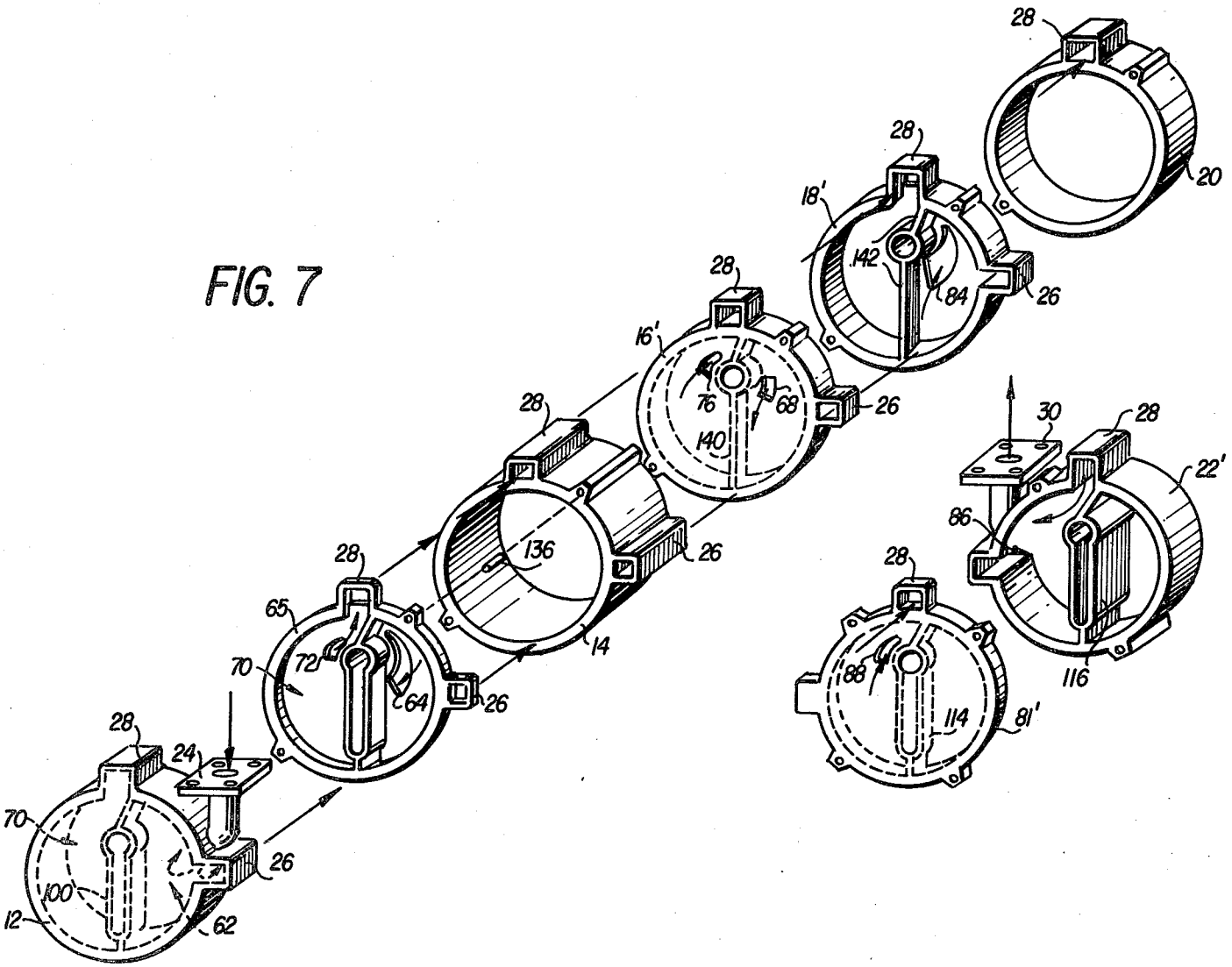
FIG. 7 shows an exploded view of the casing sections of a parallel, single stage pump apparatus according to the invention.

FIGS. 5 and 6 also illustrate the unique interlocking features of the present invention which permit the use of flat mating end surfaces rather than conventional rabbeted mating joint geometry found on prior art liquid ring pumps. A pair of essentially diametrically opposed, radially extending tabs 132/132' and 134/134' are provided which include a bore or other depression of substantial depth. Similar tabs and bores are also provided on the remaining casing sections as shown in FIGS. 4 and 7. To assemble the pump, dowels 136 are inserted in the bores and tabs of some of the components and the bores of the tabs in the mating surface of the adjacent component are slid over the extending portion of the dowel. The use of this type of joint geometry between casing sections eliminates a substantial number of machining operations during manufacture of the device and also permits the flat joint surfaces to be more easily milled or ground. The capability of milling or grinding these surfaces during manufacture can be very important when the casing sections are coated with an irregular finish such as glass which is sometimes provided for its anti-corrosion properties.

FIG. 7 shows an exploded view of pump casing 10 similar in most respects to that shown in FIG. 4 except that this casing is configured to permit parallel operation of two single stage pumps, rather than a two-stage compound pump such as shown in FIG. 4. Casing sections 16, 18, 81 and 22 have been replaced by modified versions 16', 18', 81' and 22' as indicated. First stage center plate 16' differs from first stage center plate 16 by the optional removal of radial walls 104 and 106 and the necessary addition of an interior wall 140 (shown in phantom) which extends essentially diametrically across the plate to separate ports 68 and 76. Second stage center plate 18' differs from second stage center plate 18 by the optional omission of radially extending walls 108 and 110, circumferential wall section 112 and seal plate 138 and the necessary addition of an interior wall 142 which is congruent with interior wall 140 of center plate 16'. Thus, fluid flowing in through manifold 26 reaches both suction ports 68 and 84. End plate 81' is identical to end plate 81 except for the omission of inlet port 80 and the relocation of the top of interior wall 114 to the other side of manifold 28. End casing 22' is similarly modified to relocate the top of interior wall 116 so as to mate with wall 114 in end plate 81'. The flow through the first and second impellers in this embodiment is completely in parallel, with the first stage having suction ports 64, 68 and exhaust ports 72, 76 located at both ends of impeller 58 and the second stage having suction port 84 located at one end and exhaust port 88 at the other end of impeller 60.

Figure 8:
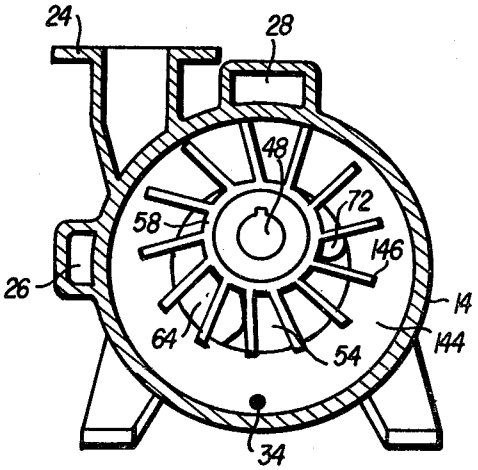
FIG. 8 shows a simplified, sectional view taken along line 8—8 of FIG. 2, indicating the unique impeller geometry of the invention.

FIG. 8 shows a schematic view taken along line 8—8 of FIG. 2 to illustrate the familiar interior geometry and operational principles of a liquid ring pump, and to show the unique impeller according to the present invention. Impeller 58 is mounted on shaft 48 for counterclockwise motion at an eccentric location in chamber 54, as indicated. When the pump is operating, sealing liquid 144 is thrown to the periphery of body portion 14 by impeller 58 where it forms a moving ring of liquid around a central void. Blades 146 of impeller 58 rotate concentrically about shaft 48 but eccentrically with respect to liquid ring 144. Suction port 64 and discharge port 72 are exposed to the central void, but are separated from each other by the impeller blades and the liquid ring. As the gas or vapor is drawn through suction port 64, it is trapped in the radial displacement chambers between blades 146 and liquid ring 144. During rotation, blades 146 enter deeper into liquid ring 144 as discharge port 72 is approached, thereby compressing the gas or vapor in the familiar manner.

As in any piece of rotating machinery, the vibration characteristics of the various components of the device must be adjusted as required to ensure acceptable operating vibration and noise levels. Mechanical imbalances in impeller 58 and shaft 48 can be largely eliminated by careful balancing; however, if the rotational frequency of the machine or any other excitation frequency is within approximately 20% of the natural frequency of the shaft, serious amplification of these exciting forces may occur. These exciting frequencies may also be significant at harmonics or multiples of the rotational frequency and at sub-harmonics or fractions thereof. In the case of a machine having an impeller with a plurality of blades, the movement of each blade past a given reference point creates an excitation force. Depending on the number of these blades and their frequency, unacceptable vibration and/or airborne noise may result.

For example, assuming an operating speed of 1800 rpm, an impeller having the commonly used number of 12 blades would have a rotational blade excitation frequency of 360 cps. Excitation forces would thus occur at this frequency and at multiples and fractions of it. Applicant has observed that blade "pairing" frequently occurs with 12-bladed impellers to produce excitation forces at frequencies of 90 cps for four groups of three blades; 120 cps for three groups of four blades; 180 cps for two groups of six blades. Similar pairings would be expected with other impellers, depending on how many pairs can exist for a given total number of blades.

To eliminate this "pairing" phenomenon, applicant's impeller comprises a prime number of blades such as 3, 7, 11, 13, 17 or 19 blades for which only one pair exists. A thirteen blade impeller is preferred in most instances. Fewer blades result in a higher pressure drop between the radial displacement chambers and more leakage; whereas, a very large number of blades reduces the volume available for impeller displacement. In any event, the use of a prime number of blades eliminates some excitation frequencies and helps reduce vibration and noise. In view of present experience with 12-bladed impellers, the use of a 13-bladed impeller is predicted to reduce the overall effect of the blade frequency by about 25 percent. Impellers with the prime number of blades are preferred in the first stage of the compound pump shown in FIG. 2; however, they may also be used to advantage in both stages.

Having described my invention in sufficient detail to enable those skilled in the art to make and use it, I claim:

1. A liquid ring pump for gases, liquids and mixtures thereof, comprising:

a casing;

a first impeller mounted for rotation within said casing, said first impeller having radial displacement chambers, a diameter and an axial length, the ratio of said axial length to said diameter being greater than 1.06;

a second impeller mounted for rotation within said casing;

at least one first stage suction port located adjacent each end of said first impeller;

at least one second stage suction port located adjacent each end of said second impeller;

at last one first stage discharge port from said first impeller; and a first stage center plate and a second stage center plate comprising part of said casing and being mounted between said impellers, said plates defining a volume therebetween, said volume being separated into a first suction plenum for directing fluid to said at least one first stage suction port and a second suction plenum for directing fluid from said at least one first stage discharge port to said at least one second stage suction port.

2. A liquid ring pump for gases, liquids and mixtures thereof, comprising:

a casing;

a first impeller mounted for rotation within said casing, said first impeller having radial displacement chambers;

at least one first stage suction port located adjacent each end of said first impeller;

a second impeller mounted for rotation within said casing, said second impeller also having radial displacement chambers;

at least one second stage suction port for said second impeller;

at least one first stage discharge port from said first impeller; and a first stage center plate and a second stage center plate comprising part of said casing and being mounted between said impellers, said plates defining a volume therebetween, said volume being separated into a first suction plenum for directing fluid to said at least one first stage suction port and a second suction plenum for directing fluid from said at least one first stage discharge port to said at least one second stage suction port.

3. A liquid ring pump for fluids including gases, liquids, and combinations thereof comprising:

a casing;

a pump inlet and a pump outlet each connected to said casing;

a first pumping chamber within said casing and having first and second ends;

a first impeller mounted for rotation within said first pumping chamber;

a second pumping chamber within said casing coaxial with said first pumping chamber and having first and second ends;

a second impeller coaxial with said first impeller and mounted for rotation within said second pumping chamber;

first means comprising a pair of abutting plates located between the juxtaposed respective second and first ends of said first and second pumping chambers defining both an outlet port and an inlet port for said first pumping chamber and also an inlet port for said second pumping chamber;

second means connecting said pump inlet both with said first end of said first pumping chamber and with said second end of said first pumping chamber through said inlet port for said first pumping chamber as defined by said first means;

at last one outlet port for said second pumping chamber;

and third means connecting the outlet ports of both said pumping chambers with said pump outlet.

4. The pump of claim 3 in which said second means comprises a manifold which is integrally formed with said casing.

5. The pump of claim 3 which includes means connecting said pump inlet with said inlet port for said second pumping chamber.

6. The pump of claim 3 in which said first end of said first pumping chamber also has an outlet port and a discharge manifold interconnects the outlet ports at both ends of said first pumping chamber, said first means interconnecting said discharge manifold with said inlet means at said first end of said second pumping chamber.

7. The pump of claim 6 in which said discharge manifold also connects to an inlet port at said second end of second pumping chamber.

8. The pump of claim 7 in which said discharge manifold is integral with said casing.

9. The pump of claim 3 in which the ratio of the axial length of said first impeller to its diameter exceeds 1.06.

10. The pump of claim 3 in which the ratio of the axial length of said first impeller to its diameter has a value from about 1.2 to about 1.5.

11. A liquid ring pump for gases, liquids and mixtures thereof, comprising:

a casing;

a first pumping chamber defined within said casing, said chamber being configured to facilitate flow of said gases, liquids and mixtures thereof axially along said casing from one end of said chamber to the other;

a first impeller mounted for rotation within said first pumping chamber in said casing, said first impeller having radial displacement chambers, a diameter and an axial length, the ratio of said axial length to said diameter being greater than 1.06;

said impeller comprising a prime number of said radial displacement chambers;

means for introducing a liquid into said chamber to form said liquid ring; and at least one suction port located adjacent each end of said first impeller.

12. A pump according to claim 11, wherein the number of said radial displacement chambers is selected from the prime number grouping consisting of the prime numbers 7, 11, 13, 17 and 19.

* * * * *